US010472213B2

(12) United States Patent
Nakashima et al.

(10) Patent No.: US 10,472,213 B2
(45) Date of Patent: Nov. 12, 2019

(54) LATTICE BOOM

(71) Applicants: Kobe Steel, Ltd., Kobe-shi (JP); KOBELCO CONSTRUCTION MACHINERY CO., LTD., Hiroshima-shi (JP)

(72) Inventors: Yasuhiro Nakashima, Kobe (JP); Shinji Sato, Kobe (JP)

(73) Assignees: Kobe Steel, Ltd., Kobe-shi (JP); KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 351 days.

(21) Appl. No.: 15/239,137

(22) Filed: Aug. 17, 2016

(65) Prior Publication Data

US 2017/0057796 A1 Mar. 2, 2017

(30) Foreign Application Priority Data

Aug. 31, 2015 (JP) ..... 2015-170991

(51) Int. Cl.
*B66C 23/66* (2006.01)
*B66C 23/64* (2006.01)

(52) U.S. Cl.
CPC ..... *B66C 23/66* (2013.01); *B66C 23/64* (2013.01)

(58) Field of Classification Search
CPC ..... B66C 23/28; B66C 23/344; B66C 23/62; B66C 23/64; B66C 23/66; B66C 23/68;
(Continued)

(56) References Cited

U.S. PATENT DOCUMENTS 473,522 A * 4/1892 Pitt ..... E04H 12/10 52/651.03
835,279 A * 11/1906 Haskell ..... E04H 12/10 52/651.02

(Continued)

FOREIGN PATENT DOCUMENTS

DE 20 2013 003 432 U1 8/2014
JP H 02-023621 U 2/1990

(Continued)

OTHER PUBLICATIONS

Machine Translation of DE 202013033432 (attached).*
Extended European Search Report dated Jan. 25, 2017 in Patent Application No. 16185083.9.

*Primary Examiner* — Michael R Mansen
*Assistant Examiner* — Juan J Campos, Jr.
(74) *Attorney, Agent, or Firm* — Oblon, McClelland, Maier & Neustadt, L.L.P.

(57) ABSTRACT

Provided is a lattice boom in which a desired part can be reinforced after the lattice boom has been assembled and in which workability of the reinforcement can be improved. The lattice boom includes a plurality of main pipes, a plurality of lattice pipes, and a reinforcing part. The reinforcing part is provided on at least one of the outer circumferential surface of the main pipe and the outer circumferential surface of the lattice pipe. The reinforcing part is arranged between adjacent connecting parts among a plurality of connecting parts each connecting the main pipe and the lattice pipe. The reinforcing part includes a plurality of reinforcing members arranged along the circumferential direction of the pipe.

11 Claims, 18 Drawing Sheets

(58) Field of Classification Search
CPC ..... B66C 23/70; E04H 12/10; E04H 12/18; E04H 12/182; E04H 12/187; E04C 3/02; E04C 3/04; E04C 3/08; B21D 47/01
USPC ..... 52/650.1, 646, 651.05, 651.07, 651.01, 52/648.1; 29/897.35
See application file for complete search history.

(56) References Cited

U.S. PATENT DOCUMENTS

| | | | | |
|---|---|---|---|---|
| 960,666 | A * | 6/1910 | De Miffonis | E04B 1/3205 52/146 |
| 3,564,789 | A | 2/1971 | Wesley et al. | |
| 4,660,336 | A * | 4/1987 | Cazaly | E04H 12/30 52/192 |
| 7,823,347 | B1 | 11/2010 | Blinn | |
| 2012/0023859 | A1 * | 2/2012 | Johnson | E04H 12/347 52/651.07 |

FOREIGN PATENT DOCUMENTS

| | | |
|---|---|---|
| JP | 3-13676 | 1/1991 |
| JP | 2011-11911 | 1/2011 |

* cited by examiner

LATTICE BOOM

TECHNICAL FIELD

The present invention relates to a lattice boom formed of a plurality of main pipes connected to each other with a plurality of lattice pipes.

BACKGROUND ART

In working machines such as a mobile crane, a boom of a lattice structure is raised and lowered. A lattice boom has a rectangular sectional shape, and a main pipe is arranged at each of four corners of the rectangle. The main pipes are joined to each other by a lattice pipe.

To improve the buckling strength of a lattice boom, it suffices to increase the diameter of a main pipe or lattice pipe or to increase the plate thickness. However, in such cases, the weight of the lattice boom increases. Therefore, the weight of a suspended load that can be lifted with the same tension decreases, thus decreasing the crane performance.

Japanese Unexamined Patent Publication No. 2011-11911 discloses a mobile crane in which a plate member is connected to the inner circumferential surface of a main pipe. Accordingly, deformation of the main pipe due to buckling that occurs along the connecting direction of the plate member from the outer side toward the center of the main pipe can be suppressed.

Japanese Unexamined Patent Publication No. H3-13676 discloses a reinforcing structure for a truss structure. In the reinforcing structure, a reinforcing rib is formed at the outer circumferential surface of a main truss member. Accordingly, part of load to be borne by the main truss member is borne by the reinforcing rib, and therefore the truss structure can be configured of the main truss member with a small diameter.

SUMMARY OF INVENTION

However, the configuration described in Japanese Unexamined Patent Publication No. 2011-11911 in which the plate member is connected to the inner circumferential surface of the main pipe does not allow for reinforcement of a part that has become desirable after a lattice boom has been assembled. In contrast, the configuration described in Japanese Unexamined Patent Publication No. H3-13676 in which the reinforcing rib is provided to the outer circumferential surface of the main pipe allows for reinforcement of a part that has become desirable after a lattice boom has been assembled. However, since the reinforcing rib is provided in an area spanning across a connecting part of a main pipe and a lattice pipe, there is a problem that workability of the reinforcement after assembly is low.

An object of the present invention is to provide a lattice boom in which a desired part can be reinforced after the lattice boom has been assembled and in which workability of the reinforcement can be improved.

A lattice boom according to the present invention includes a plurality of main pipes extending in a longitudinal direction of the lattice boom, a plurality of lattice pipes extending in a connecting direction that intersects with the longitudinal direction and each including two ends respectively connected to a pair of adjacent main pipes, among the plurality of main pipes, to connect the pair of main pipes, and a reinforcing part provided on at least one of an outer circumferential surface of the main pipe and an outer circumferential surface of the lattice pipe. The reinforcing part is provided to at least one of a first area between connecting parts adjacent to each other at a predetermined interval along the longitudinal direction on the outer circumferential surface of the main pipe, among a plurality of connecting parts each connecting the main pipe and the lattice pipe, and a second area between the connecting parts on two end sides of the lattice pipe. The reinforcing part includes a plurality of reinforcing members that extend along an axial direction of a pipe, out of the main pipe and the lattice pipe, which includes the reinforcing part, and are arranged at intervals on the outer circumferential surface of the pipe along a circumferential direction of the pipe.

With the reinforcing member being provided to the outer circumferential surface of the pipe (main pipe or lattice pipe) in the present invention, a desired part can be reinforced after the lattice boom has been assembled. By two or more of the reinforcing members being provided in the circumferential direction of the outer circumferential surface of the pipe, the sectional stiffness of the pipe in a direction in which the reinforcing member meets the outer circumferential surface of the pipe is improved. Therefore, the reinforcing member can improve the buckling strength of the pipe with respect to load applied in a direction intersecting with the outer circumferential surface of the pipe. Further, the reinforcing member is arranged between the connecting parts of the main pipe and the lattice pipe. Therefore, in the case of reinforcement of a part that has become desirable after the lattice boom has been assembled, a worker does not need to perform reinforcement work of arranging the reinforcing member such that the reinforcing member spans across the connecting part of the main pipe and the lattice pipe. Thus, a desired part can be reinforced after the lattice boom has been assembled, and workability of the reinforcement can be improved.

BRIEF DESCRIPTION OF DRAWINGS

FIG. 17 is a sectional view on A-A in FIG. 3 in a thirteenth modified example of the present invention; on;

DESCRIPTION OF EMBODIMENTS

Preferred embodiments of the present invention will be described below with reference to the drawings.

First Embodiment (Configuration of Crane)

Figure 1:
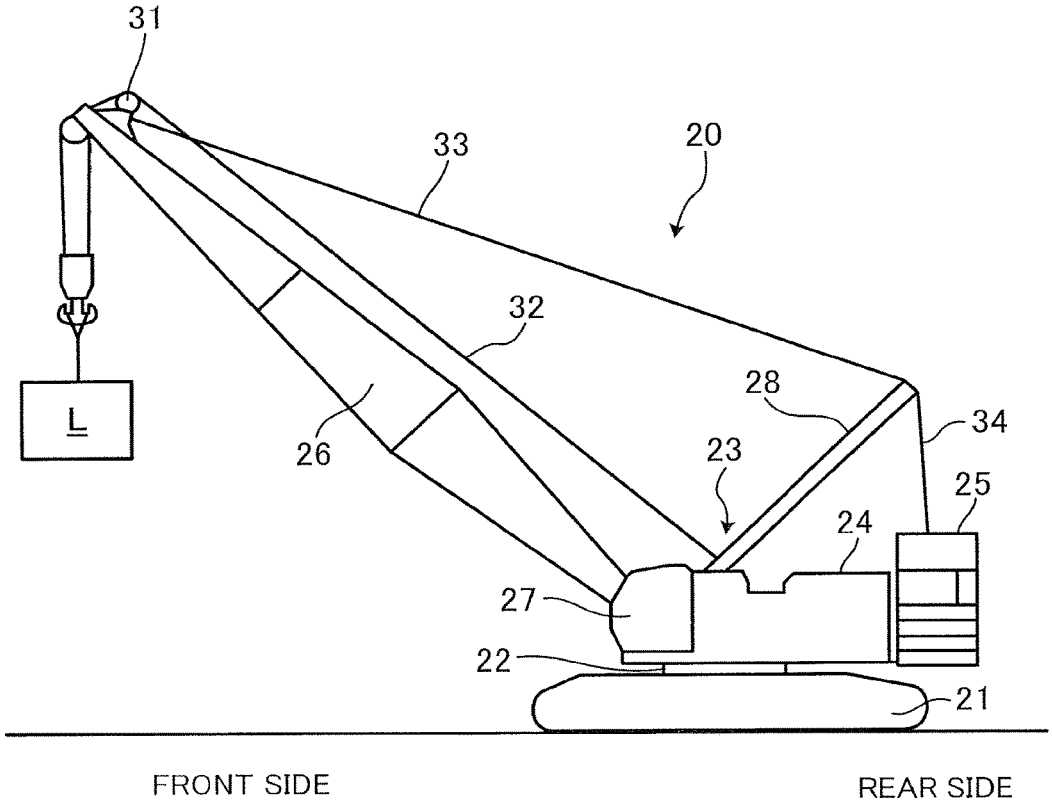
FIG. 1 is a side view of a crane according to an embodiment of the present invention.

A lattice boom according to a first embodiment of the present invention is provided to a crane 20 that is a working machine. FIG. 1 is a side view of the crane 20. As shown in FIG. 1, the crane 20 performs, for example, work (cargo work) of lifting a suspended load L with a lattice boom 26. The crane 20 is a mobile crane. In other words, the crane 20 is a crawler crane, or a lattice-boom crawler crane. The crane 20 may be a wheel crane including a lattice boom.

The crane 20 includes an lower traveling body 21, a swing bearing 22, and an upper slewing body 23. The lower traveling body 21 is a continuous track vehicle. The upper slewing body 23 is provided to be revolvable on the lower traveling body 21 with the swing bearing 22 therebetween.

The upper slewing body 23 includes an upper body 24, a counterweight 25, the lattice boom 26, a cab (operating cabin) 27, and a mast 28. Hereinafter, the lattice boom 26 side is referred to as the front side, and the counterweight 25 side is referred to as the rear side.

The upper body 24 is mounted (attached) to be revolvable with respect to the lower traveling body 21. The counterweight 25 is a weight to balance against the suspended load L of the crane 20. The counterweight 25 is attached to allow for disassembly to the rear end of the upper body 24.

The lattice boom 26 is a member to be raised and lowered to perform lifting or the like of the suspended load L. The lattice boom 26 is formed of a plurality of main pipes connected to each other with a plurality of lattice pipes. The lattice boom 26 is attached at the front end of the upper body 24 to a revolving frame forming the upper body 24, such that raising and lowering is possible. To the tip end of the lattice boom 26, a sheave 31 is attached. Around the sheave 31, a rope 32 to be wound up and down with a winch drum (not shown) provided to the upper body 24 is wound.

The mast 28 is provided on the rear side of the lattice boom 26. The tip end of the mast 28 and the tip end of the lattice boom 26 are joined via a guide line 33. The tip end (upper spreader, not shown) of the mast 28 and a lower spreader (not shown) provided to the rear of the upper body 24 are joined via a boom raising-and-lowering rope 34. By a winch (not shown) provided to the upper body 24 pulling in or letting out the boom raising-and-lowering rope 34, the mast 28 is raised or lowered, and the lattice boom 26 is raised or lowered.

(Lattice Boom)

Figure 2A:
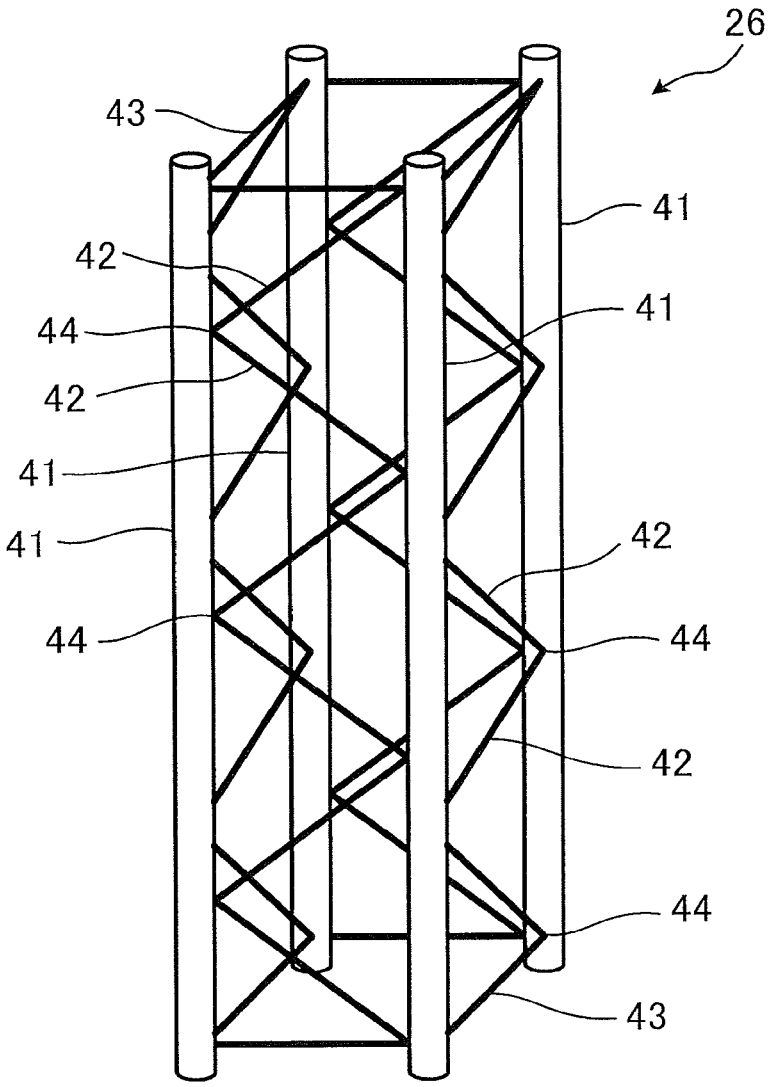
FIG. 2A is a perspective view of a lattice boom of the crane in FIG. 1
Figure 2B:
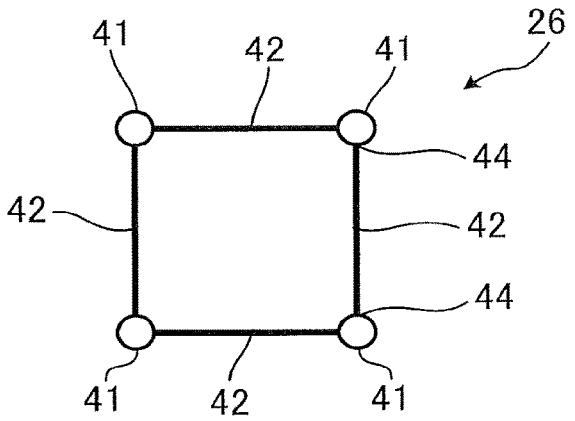
FIG. 2B is a sectional view of the lattice boom in FIG. 2A.

FIG. 2A is a perspective view of the lattice boom 26, and FIG. 2B is a sectional view of the lattice boom 26. The lattice boom 26 has a rectangular sectional shape, and a hollow main pipe 41 is arranged at each of four corners of the rectangular shape. The plurality of main pipes 41 extend along the longitudinal direction of the lattice boom 26. The main pipes 41 are joined to each other by a plurality of lattice pipes 42. Ends in the axial direction of the main pipes 41 (longitudinal direction of the lattice boom 26) are joined by a plurality of frame pipes 43. The frame pipe 43 is formed of a structure equivalent to that of the lattice pipe 42. The lattice pipe 42 and the frame pipe 43 respectively extend in directions (referred to as connecting directions) that intersect with the longitudinal direction of the lattice boom 26. The lattice pipe 42 and the frame pipe 43 are connected to the main pipe 41 by welding at a connecting part 44. That is, the plurality of lattice pipes 42 and the plurality of frame pipes 43 each include two ends respectively connected to a pair of adjacent main pipes 41, among the plurality of main pipes 41, to connect the pair of main pipes 41. The main pipe 41 serves a role of bearing load in the axial direction applied to the lattice boom 26. The lattice pipe 42 serves a role of maintaining the sectional shape of the lattice boom 26 by maintaining the distance between the main pipes 41.

(Reinforcing Structure for Lattice Boom)

Figure 3:
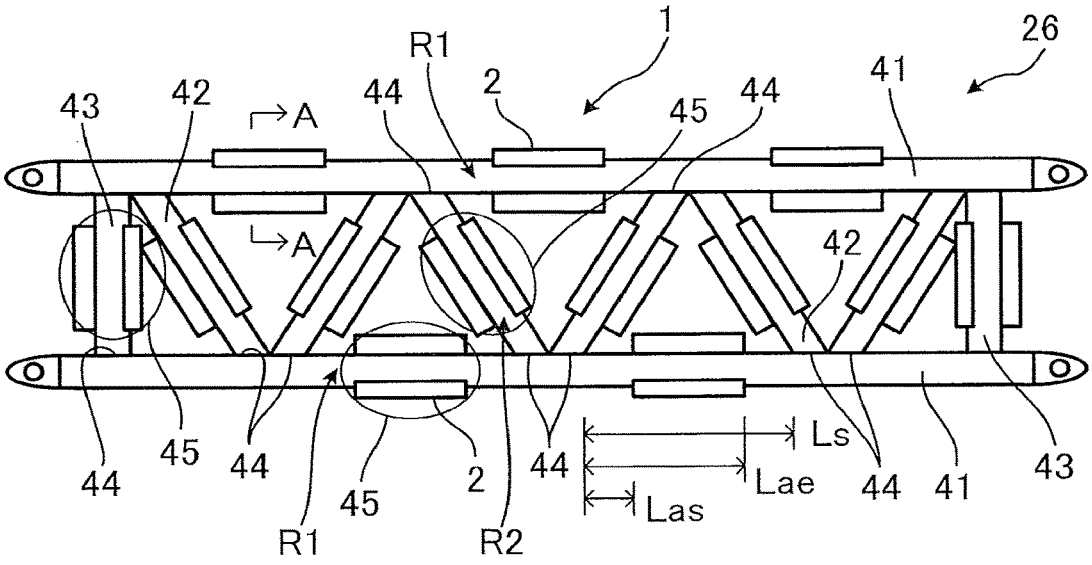
FIG. 3 is a side view of a lattice boom in a first embodiment of the present invention.
Figure 4:
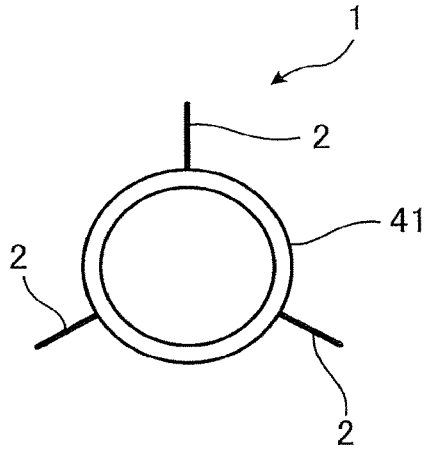
FIG. 4 is a sectional view on A-A in FIG. 3 in the first embodiment of the present invention.

FIG. 3 is a side view of the lattice boom 26. The lattice boom 26 of this embodiment includes a reinforcing structure 1. The reinforcing structure 1 is formed of a plurality of reinforcing parts. The reinforcing part is provided to each of the outer circumferential surfaces of the main pipe 41, the lattice pipe 42, and the frame pipe 43 and includes a reinforcing member 2 that extends in the axial direction of the corresponding pipe. FIG. 4 is a sectional view on A-A in FIG. 3. As shown in FIG. 4, the reinforcing member 2 is plate-shaped and attached by welding or the like to extend outward from the outer circumferential surface of the main pipe 41.

As shown in FIG. 4, three reinforcing members 2 are provided at equal or approximately the same intervals along the circumferential direction on the outer circumferential surface of the main pipe 41. In this embodiment, the three reinforcing members 2 are provided at equal intervals (120° intervals) along the circumferential direction on the outer circumferential surface of the main pipe 41. A plurality of the reinforcing members 2 provided to the lattice pipe 42 and the frame pipe 43 are also arranged in a similar manner along the respective circumferential directions. In the present invention, approximately the same interval refers to an interval slightly greater than or slightly smaller than an equal interval. The difference of the angle between the reinforcing members 2 arranged at equal intervals and the angle between the reinforcing members 2 arranged at approximately the same intervals is approximately ±20%. For example, if the angle between the reinforcing members 2 arranged at equal intervals is 120°, the angle between the reinforcing members 2 arranged at approximately the same interval is approximately 100° to 140°.

As shown in FIG. 3, the reinforcing member 2 of the reinforcing part provided to the main pipe 41 and the lattice pipe 42 is arranged between the connecting parts 44 of the main pipe 41 and the lattice pipe 42. In a similar manner, the reinforcing member 2 of the reinforcing part provided to the frame pipe 43 is arranged between the connecting parts 44 of the main pipe 41 and the frame pipe 43. A portion between the connecting parts 44 of each pipe is referred to as an intermediate part 45. In this embodiment, the reinforcing member 2 of the reinforcing part is arranged at each intermediate part 45. To put it another way, in the case where the reinforcing part of the reinforcing structure 1 is arranged on the main pipe 41, the reinforcing part is arranged in a first area R1 (see FIG. 3) between the connecting parts 44 adjacent to each other at a predetermined interval along the longitudinal direction on the outer circumferential surface of the main pipe 41. In the case where the reinforcing part is arranged on the lattice pipe 42, the reinforcing part is arranged in a second area R2 (see FIG. 3) between the connecting parts 44 on two end sides of the lattice pipe 42. The second area R2 corresponds to an area between the connecting parts 44 adjacent to each other at a predetermined interval along the connecting direction (axial direction of the lattice pipe 42) on the outer circumferential surface of the lattice pipe 42.

Herein, as shown in FIG. 3, the length of the predetermined interval between the adjacent connecting parts 44 is defined as Ls, the length from one connecting part 44 as a starting point up to one end of the reinforcing member 2 on the starting point side as Las, and the length from the starting point up to the other end of the reinforcing member 2 on the opposite side of the one end as Lae. The length of the reinforcing member 2 in the axial direction is set to less than or equal to the interval Ls between the adjacent connecting parts 44. Particularly, the reinforcing member 2 is desirably arranged in a range where Las is greater than or equal to 5% of Ls and where Lae is less than or equal to 95% of Ls. As the length of the reinforcing member 2 increases, the buckling strength of the reinforcing member 2 improves, but the weight of the reinforcing member 2 increases. There is a trade-off between the degree of improvement in buckling strength and the amount of increase in weight of the reinforcing member 2. Therefore, Las and Lae are desirably determined in accordance with the design requirements.

With the reinforcing member 2 included in the reinforcing part of the reinforcing structure 1 being provided to the outer circumferential surface of the pipe (main pipe 41, lattice pipe 42, or frame pipe 43) in this manner, a worker can reinforce a desired part after the lattice boom 26 has been assembled. By three or more of the reinforcing members 2 being provided at equal or approximately the same intervals in the circumferential direction of the outer circumferential surface of the pipe, the sectional stiffness of the pipe is improved over the entire circumference of the outer circumferential surface. Therefore, the buckling strength of the pipe can be improved in all directions that intersect with the outer circumferential surface of the pipe. The arrangement of the reinforcing member 2 between the connecting parts 44 of the main pipe 41 and the lattice pipe 42 and between the connecting parts 44 of the main pipe 41 and the frame pipe 43 allows for reinforcement of a part that has become desirable after the lattice boom 26 has been assembled. In this case, a worker does not need to perform reinforcement work of arranging a reinforcing member such that the reinforcing member spans across the connecting part 44 of the main pipe 41 and the lattice pipe 42 or the connecting part 44 of the main pipe 41 and the frame pipe 43. Thus, a desired part can be reinforced after the lattice boom 26 has been assembled, and workability of the reinforcement can be improved.

Modified Example

Figure 5:
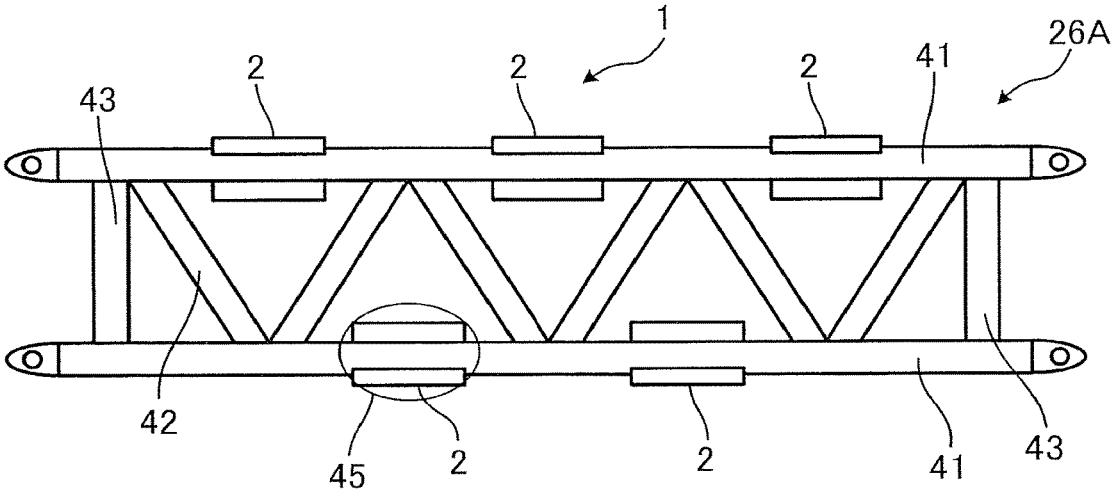
FIG. 5 is a side view of a lattice boom in a first modified example of the present invention.
Figure 6:
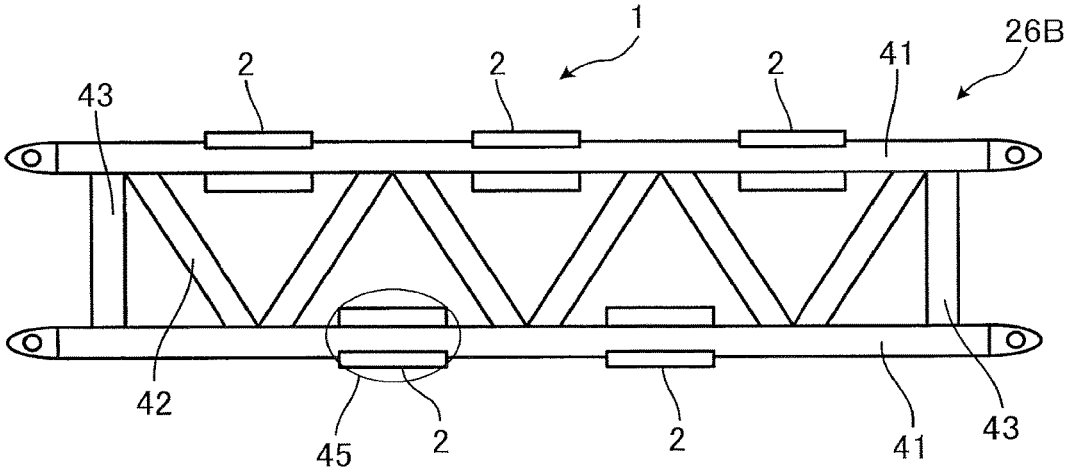
FIG. 6 is a side view of a lattice boom in a second modified example of the present invention.
Figure 7:
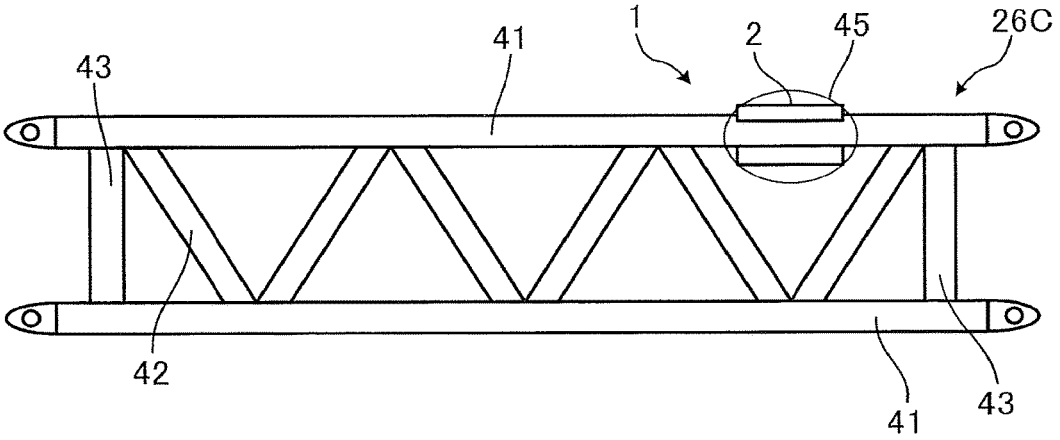
FIG. 7 is a side view of a lattice boom in a third modified example of the present invention.

Next, modified examples will be described. FIG. 5 is a side view of a lattice boom 26A according to a first modified example. As shown in FIG. 5, the reinforcing member 2 is provided to only each of the respective intermediate parts 45 (first areas) of the main pipes 41. FIG. 6 is a side view of a lattice boom 26B according to a second modified example. As shown in FIG. 6, the reinforcing member 2 is provided to only each of the respective intermediate parts 45 (first areas) of the main pipe 41 on the upper side in the drawing. FIG. 7 is a side view of a lattice boom 26C according to a third modified example. As shown in FIG. 7, the reinforcing member 2 is provided to only a certain intermediate part 45 (first area) among the respective intermediate parts 45 of the main pipes 41. In this manner, even in the case where the reinforcing member 2 is provided to only a desired part of the outer circumferential surface of the main pipes 41, the buckling strength of the lattice boom 26 can be improved while suppressing an increase in weight.

Figure 8:
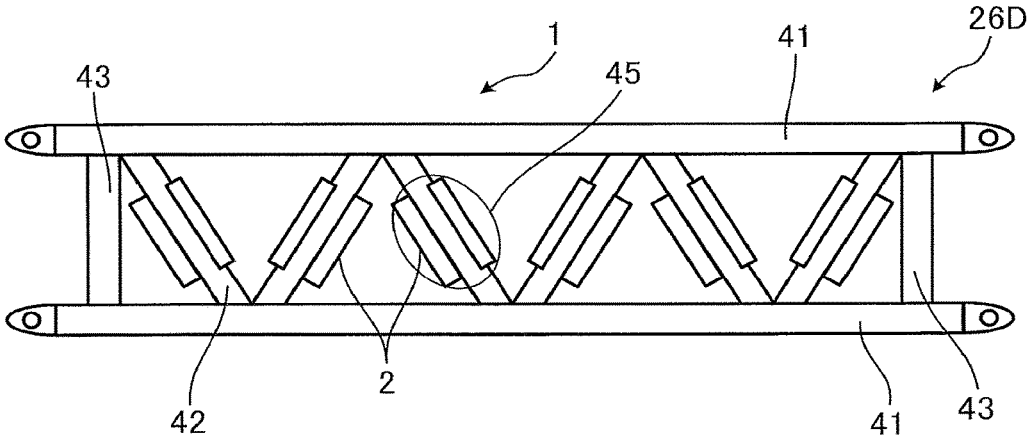
FIG. 8 is a side view of a lattice boom in a fourth modified example of the present invention.
Figure 9:
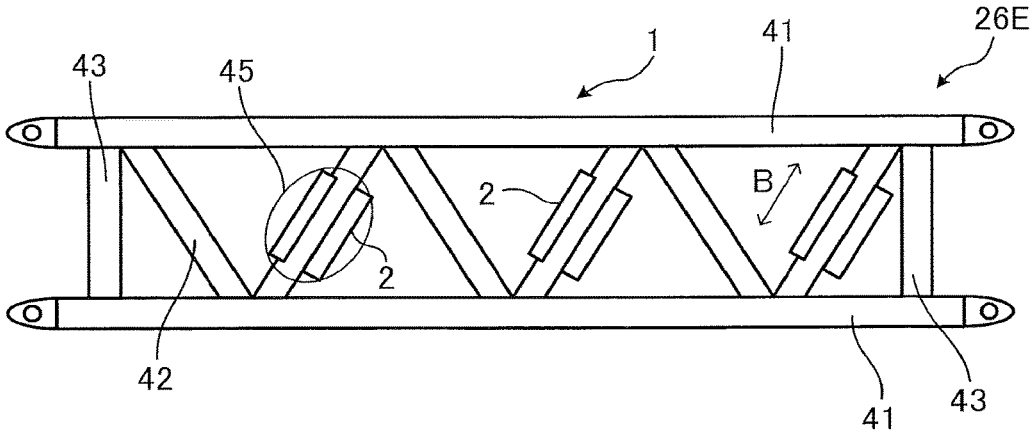
FIG. 9 is a side view of a lattice boom in a fifth modified example of the present invention.
Figure 10:
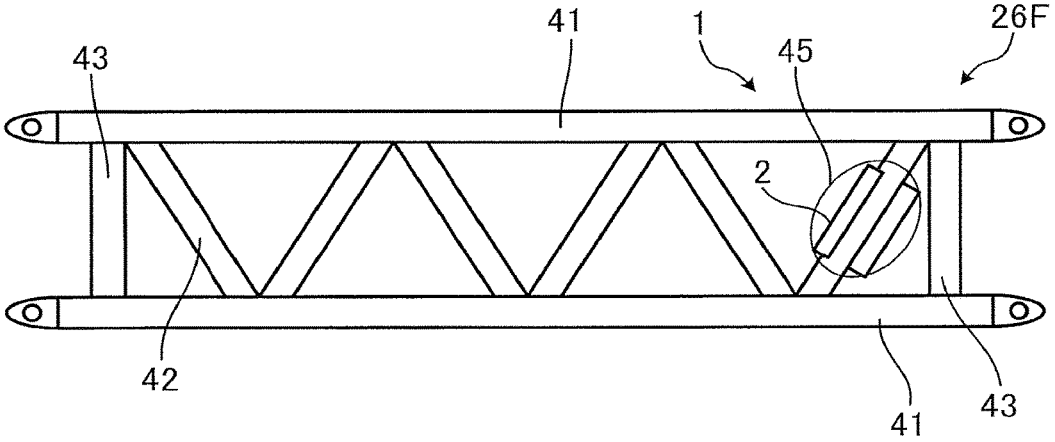
FIG. 10 is a side view of a lattice boom in a sixth modified example of the present invention.

FIG. 8 is a side view of a lattice boom 26D according to a fourth modified example. As shown in FIG. 8, the reinforcing member 2 is provided to only each of the respective intermediate parts 45 (second areas) of the lattice pipes 42. FIG. 9 is a side view of a lattice boom 26E according to a fifth modified example. As shown in FIG. 9, the reinforcing member 2 is provided to only each of the respective intermediate parts 45 (second areas) of the lattice pipes 42 parallel to the direction of arrow B. FIG. 10 is a side view of a lattice boom 26F according to a sixth modified example. As shown in FIG. 10, the reinforcing member 2 is provided to only a certain intermediate part 45 (second area) among the respective intermediate parts 45 of the lattice pipes 42. In this manner, even in the case where the reinforcing member 2 is provided to only a desired part of the outer circumferential surface of the lattice pipes 42, the buckling strength of the lattice boom 26 can be improved while suppressing an increase in weight.

Figure 11:
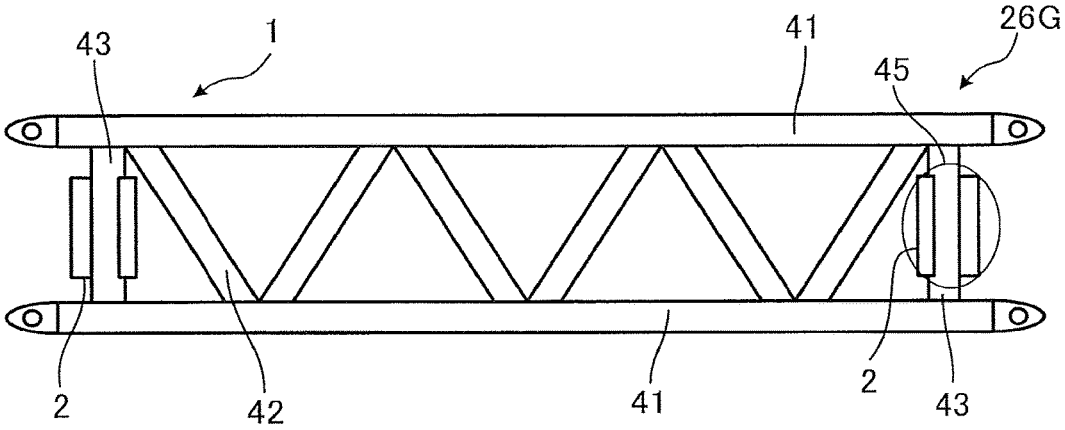
FIG. 11 is a side view of a lattice boom in a seventh modified example of the present invention.
Figure 12:
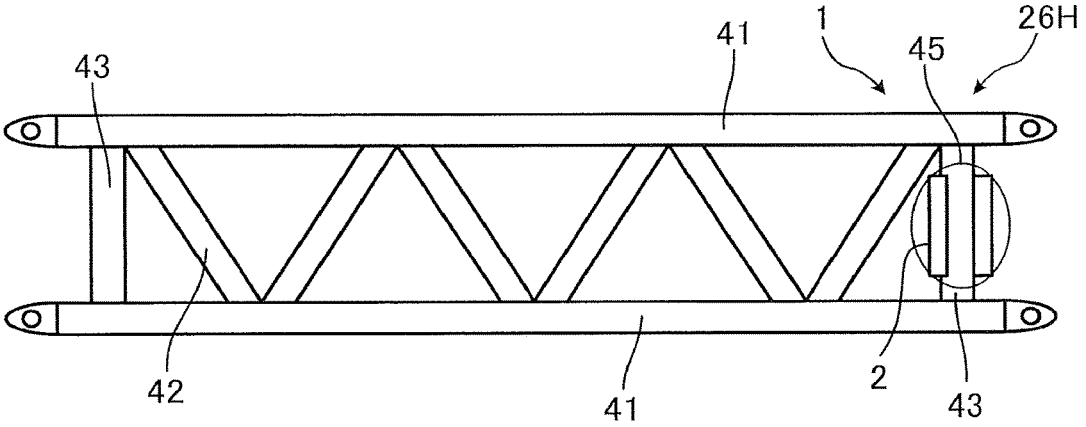
FIG. 12 is a side view of a lattice boom in an eighth modified example of the present invention.
Figure 13:
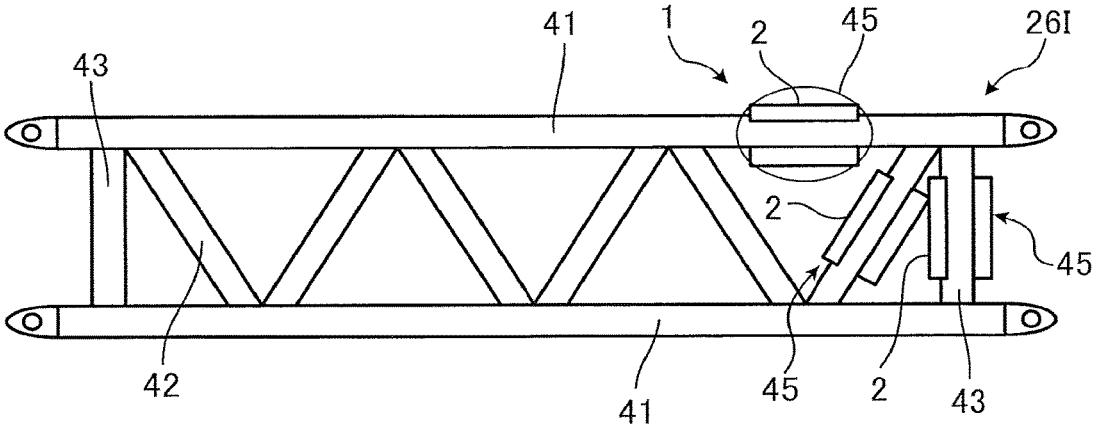
FIG. 13 is a side view of a lattice boom in a ninth modified example of the present invention.

FIG. 11 is a side view of a lattice boom 26G according to a seventh modified example. As shown in FIG. 11, the reinforcing member 2 is provided to only each of the respective intermediate parts 45 of the frame pipes 43. FIG. 12 is a side view of a lattice boom 26H according to an eighth modified example. As shown in FIG. 12, the reinforcing member 2 is provided to only the intermediate part 45 of the frame pipe 43 on the right side in the drawing. FIG. 13 is a side view of a lattice boom 26I according to a ninth modified example. As shown in FIG. 13, the reinforcing member 2 is provided to each of the intermediate part 45 (first area) in the upper right in the drawing among the respective intermediate parts 45 of the main pipes 41, the intermediate part 45 (second area) on the right side in the drawing among the respective intermediate parts 45 of the lattice pipes 42, and the intermediate part 45 on the right side in the drawing among the respective intermediate parts 45 of the frame pipes 43, so as to reinforce a part in the upper right in the drawing in particular. By providing the reinforcing member 2 to a desired part in this manner, the buckling strength of the lattice boom 26 can be improved while suppressing an increase in weight.

Figure 14:
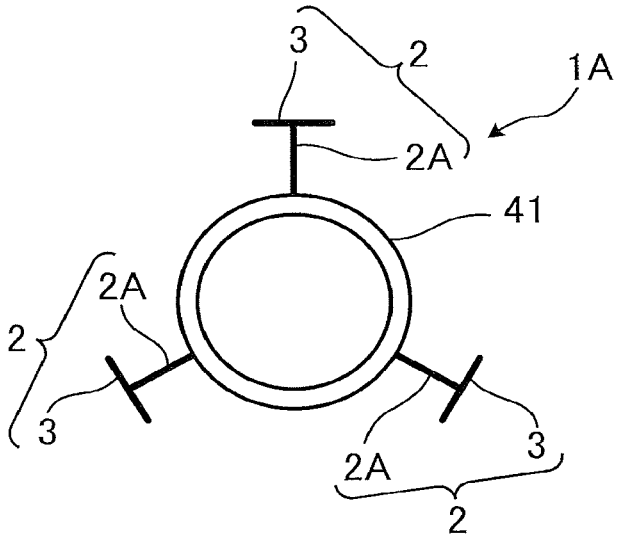
FIG. 14 is a sectional view on A-A in FIG. 3 in a tenth modified example of the present invention.

FIG. 14 is a sectional view of a reinforcing structure 1A according to a tenth modified example and is a sectional view of the same position as for the section on A-A in FIG. 3. As shown in FIG. 14, the reinforcing member 2 includes a plate member 2A (first member) extending outward from the outer circumferential surface of the main pipe 41 and a plate member 3 (second member) arranged in a direction orthogonal to the plate member 2A. The plate member 3 is connected by welding to the end surface (tip end) of the plate member 2A. Accordingly, in sectional view, the plate member 2A and the plate member 3 of the reinforcing member 2 form a T-shape. The plate member 2A and the plate member 3 may be integrally molded. The stiffness of the reinforcing member 2 is improved by the plate member 3, and therefore the buckling strength of the main pipe 41 is further improved.

Figure 15:
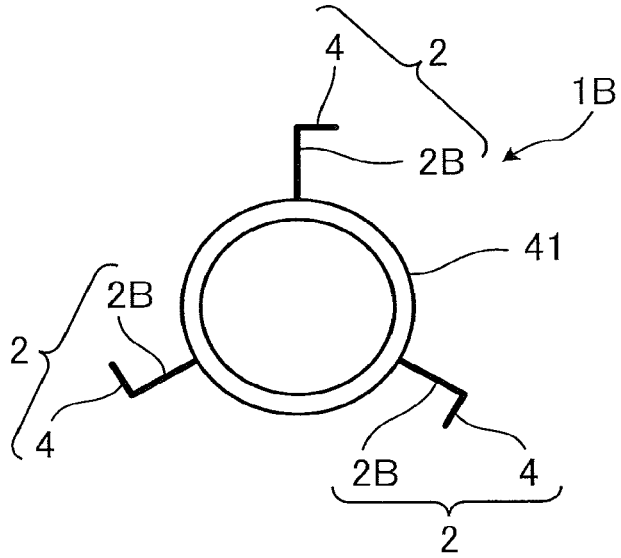
FIG. 15 is a sectional view on A-A in FIG. 3 in an eleventh modified example of the present invention.

FIG. 15 is a sectional view of a reinforcing structure 1B according to an eleventh modified example and is a sectional view of the same position as for the section on A-A in FIG. 3. As shown in FIG. 15, the reinforcing member 2 includes a plate member 2B (first member) extending outward from the outer circumferential surface of the main pipe 41 and a plate member 4 (second member) arranged in a direction orthogonal to the plate member 2B. The plate member 4 is connected by welding to the end surface (tip end) of the plate member 2B. In sectional view, the plate member 4 extends in the clockwise direction from the end surface of the plate member 2B. Accordingly, in sectional view, the plate member 2B and the plate member 4 of the reinforcing member 2 form an L-shape. The plate member 2B and the plate member 4 may be integrally molded. The stiffness of the reinforcing member 2 is improved by the plate member 4, and therefore the buckling strength of the main pipe 41 is further improved.

Figure 16:
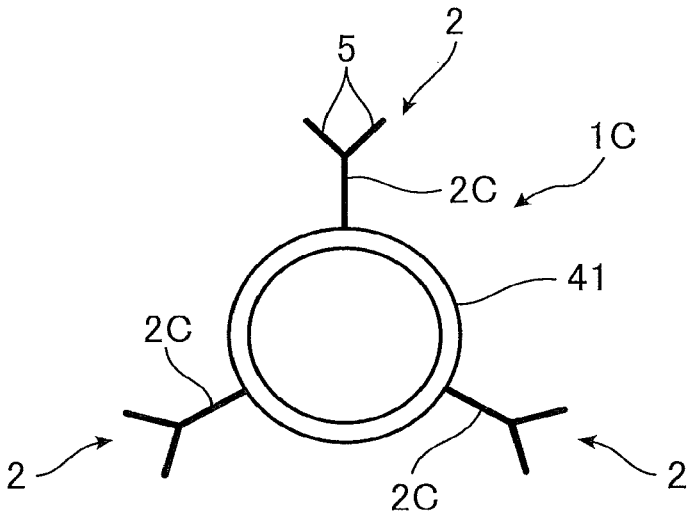
FIG. 16 is a sectional view on A-A in FIG. 3 in a twelfth modified example of the present invention.

FIG. 16 is a sectional view of a reinforcing structure 1C according to a twelfth modified example and is a sectional view of the same position as for the section on A-A in FIG. 3. As shown in FIG. 16, the reinforcing member 2 includes a plate member 2C (first member) extending outward from the outer circumferential surface of the main pipe 41 and two plate members 5 (second members) arranged in directions intersecting with the plate member 2C. The two plate members 5 are each connected by welding to the end surface (tip end) of the plate member 2C. In sectional view, the two plate members 5 respectively extend in directions away from each other from the end surface of the plate member 2C. Accordingly, in sectional view, the plate member 2C and the two plate members 5 of the reinforcing member 2 form a Y-shape. The plate member 2C and the plate member 5 may be integrally molded. The stiffness of the reinforcing member 2 is improved by the plate member 5, and therefore the buckling strength of the main pipe 41 is further improved.

Figure 17:
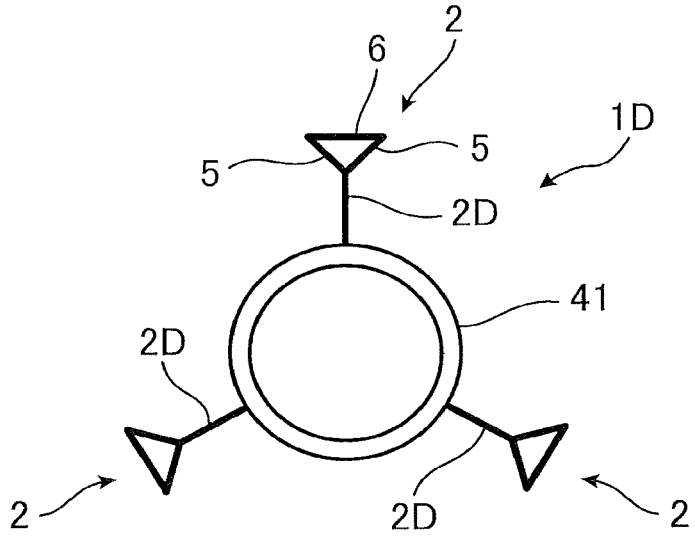

FIG. 17 is a sectional view of a reinforcing structure 1D according to a thirteenth modified example and is a sectional view of the same position as for the section on A-A in FIG. 3. In this modified example, as shown in FIG. 17, the reinforcing member 2 includes a plate member 6, in addition to a plate member 2D and the two plate members 5. The plate member 6 is provided to connect the end surfaces of the two plate members 5. The two plate members 5 and the plate member 6 form a closed space in sectional view. The plate member 2D, the plate members 5, and the plate member 6 of the reinforcing member 2 may be integrally molded. The stiffness of the plate member 5 is improved by the plate member 6, and therefore the stiffness of the reinforcing member 2 is further improved. Thus, the buckling strength of the main pipe 41 is further improved.

Figure 18:
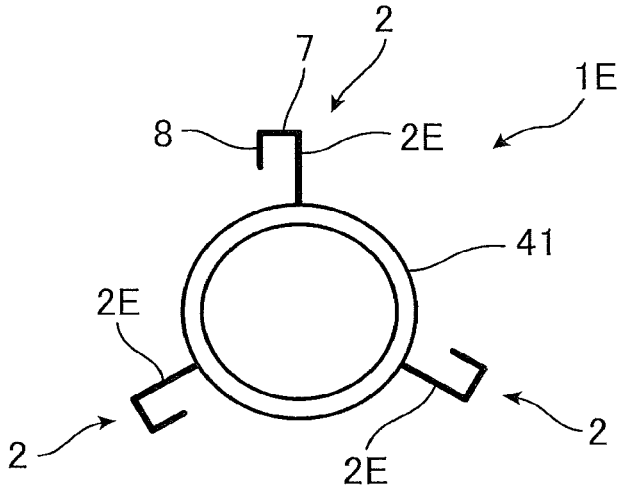
FIG. 18 is a sectional view on A-A in FIG. 3 in a fourteenth modified example of the present invention.

FIG. 18 is a sectional view of a reinforcing structure 1E according to a fourteenth modified example and is a sectional view of the same position as for the section on A-A in FIG. 3. As shown in FIG. 18, the reinforcing member 2 includes a plate member 2E, a first tip-end plate member 7 arranged in a direction orthogonal to the plate member 2E, and a second tip-end plate member 8. The first tip-end plate member 7 is connected by welding to the end surface (tip end) of the plate member 2E. Further, the second tip-end plate member 8 arranged in a direction orthogonal to the first tip-end plate member 7 is connected by welding to the end surface of the first tip-end plate member 7. In sectional view, the first tip-end plate member 7 extends in the counterclockwise direction from the end surface of the plate member 2E. The second tip-end plate member 8 extends in a direction parallel to the plate member 2E from the end surface of the first tip-end plate member 7. Accordingly, in sectional view, the plate member 2E, the first tip-end plate member 7, and the second tip-end plate member 8 of the reinforcing member 2 form a rectangular U-shape. The plate member 2E, the first tip-end plate member 7, and the second tip-end plate member 8 of the reinforcing member 2 may be integrally molded. The stiffness of the reinforcing member 2 is improved by the first tip-end plate member 7 and the second tip-end plate member 8, and therefore the buckling strength of the main pipe 41 is further improved.

Figure 19:
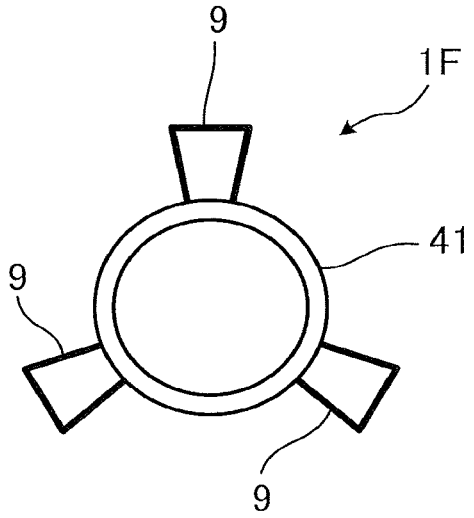
FIG. 19 is a sectional view on A-A in FIG. 3 in a fifteenth modified example of the present invention.

FIG. 19 is a sectional view of a reinforcing structure 1F according to a fifteenth modified example and is a sectional view of the same position as for the section on A-A in FIG. 3. As shown in FIG. 19, a reinforcing member 9 is formed in a shape having three sides of a (rectangular) quadrilateral in sectional view and is provided to extend outward in the axial direction thereof from the outer circumferential surface of the main pipe 41. That is, the reinforcing member 9 is rectangular U-shaped in section. The reinforcing member 9 and the outer circumferential surface of the main pipe 41 form a closed space in sectional view. Three reinforcing members 9 are provided at equal or approximately the same intervals in the circumferential direction of the outer circumferential surface of the main pipe 41. By forming the closed space with the outer circumferential surface of the main pipe 41 and the reinforcing member 9 in sectional view in this manner, the stiffness of the reinforcing member 9 can be improved while suppressing an increase in weight. Accordingly, the buckling strength of the main pipe 41 can be further improved. A cylindrical reinforcing member such as a square tube may be attached to the outer circumferential surface of the main pipe 41. The reinforcing member 9 is not limited to a rectangular shape and may be partially formed of a curved surface.

Figure 20:
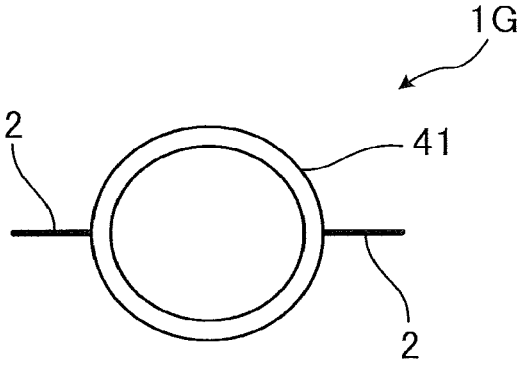
FIG. 20 is a sectional view on A-A in FIG. 3 in a sixteenth modified example of the present invention.

FIG. 20 is a sectional view of a reinforcing structure 1G according to a sixteenth modified example and is a sectional view of the same position as for the section on A-A in FIG. 3. As shown in FIG. 20, two reinforcing members 2 are provided at equal intervals (180° intervals) in the circumferential direction of the outer circumferential surface of the main pipe 41. Accordingly, the sectional stiffness of the main pipe 41 in a direction in which the reinforcing member 2 meets the outer circumferential surface of the main pipe 41 is improved, and therefore the buckling strength of the main pipe 41 with respect to load applied in the direction in which the reinforcing member 2 meets the outer circumferential surface of the main pipe 41 can be improved. The intervals of the reinforcing members 2 are not limited equal intervals and may be approximately the same intervals. The reinforcing members 2 may be provided to the outer circumferential surface of the main pipe 41 on the side on which load is applied, instead of being provided at equal or approximately the same intervals.

Figure 21:
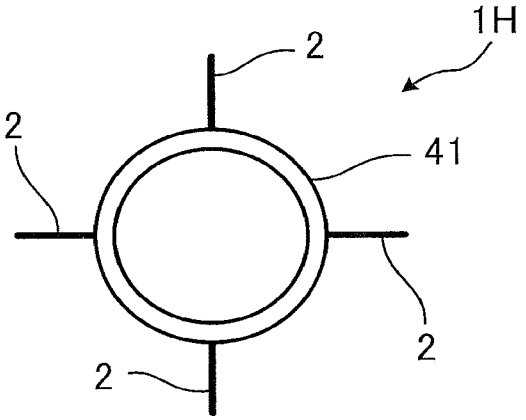
FIG. 21 is a sectional view on A-A in FIG. 3 in a seventeenth modified example of the present invention.
Figure 22:
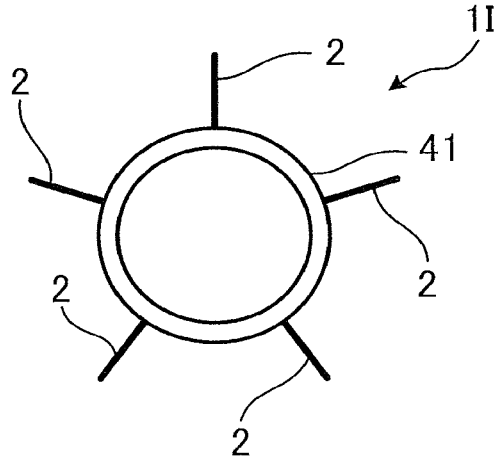
FIG. 22 is a sectional view on A-A in FIG. 3 in an eighteenth modified example of the present invention.

FIG. 21 is a sectional view of a reinforcing structure 1H according to a seventeenth modified example and is a sectional view of the same position as for the section on A-A in FIG. 3. As shown in FIG. 21, four reinforcing members 2 are provided at equal intervals (90° intervals) in the circumferential direction of the outer circumferential surface of the main pipe 41. FIG. 22 is a sectional view of a reinforcing structure 1I according to an eighteenth modified example. As shown in FIG. 22, five reinforcing members 2 are provided at equal intervals (72° intervals) in the circumferential direction of the outer circumferential surface of the main pipe 41. Accordingly, the sectional stiffness of the main pipe 41 can be improved over the entire circumference of the outer circumferential surface. In the seventeenth modified example and the eighteenth modified example, the intervals of the reinforcing members 2 are not limited equal intervals and may be approximately the same intervals.

The tenth to eighteenth modified examples apply in a similar manner to the reinforcing member 2 provided to the lattice pipe 42 or the frame pipe 43. The tenth to eighteenth modified examples may be applied to the first to ninth modified examples, besides the first embodiment. In other embodiments as well, in a similar manner to the sixteenth modified example, the reinforcing members 2 may be provided to the outer circumferential surface of each pipe on the side on which load is applied, instead of being provided at equal intervals or approximately the same intervals.

Advantageous Effect

With the reinforcing member 2 being provided to the outer circumferential surface of the pipe (main pipe 41, lattice pipe 42, or frame pipe 43) in the reinforcing structure 1 of the lattice boom according to this embodiment as described above, a desired part can be reinforced after the lattice boom 26 has been assembled. The sectional stiffness of the pipe in a direction in which the reinforcing member 2 meets the outer circumferential surface of the pipe is improved by two or more of the reinforcing members 2 being provided in the circumferential direction of the outer circumferential surface of the pipe. Therefore, the buckling strength of the pipe with respect to load applied in the direction in which the reinforcing member 2 meets the outer circumferential surface of the pipe can be improved. The arrangement of the reinforcing member 2 between the connecting parts 44 of the main pipe 41 and the lattice pipe 42 and between the connecting parts 44 of the main pipe 41 and the frame pipe 43 eliminates the need for a worker to perform reinforcement work of arranging a reinforcing member such that the reinforcing member spans across the connecting part 44 of the main pipe 41 and the lattice pipe 42 or the connecting part 44 of the main pipe 41 and the frame pipe 43, in the case of reinforcement of a part that has become desirable after the lattice boom 26 has been assembled. Thus, a desired part can be reinforced after the lattice boom 26 has been assembled, and workability of the reinforcement can be improved.

By three or more of the reinforcing members 2 being provided in the circumferential direction of the outer circumferential surface of the pipe, the sectional stiffness of the pipe can be further improved. Accordingly, the buckling strength of the pipe can be further improved.

By the reinforcing members 2 being provided at equal or approximately the same intervals in the circumferential direction of the outer circumferential surface of the pipe, the sectional stiffness of the pipe can be improved approximately evenly in the circumferential direction. Accordingly, the buckling strength of the pipe can be further improved.

Further, by three or more of the reinforcing member 2 being provided at equal or approximately the same intervals in the circumferential direction of the outer circumferential surface of the pipe, the sectional stiffness of the pipe is improved over the entire circumference of the outer circumferential surface. Therefore, the buckling strength of the pipe can be improved in all directions that intersect with the outer circumferential surface of the pipe.

Even in the case where the reinforcing member 2 is provided to only the outer circumferential surface of the main pipe 41 or in the case where the reinforcing member 2 is provided to only the outer circumferential surface of the lattice pipe 42, the buckling strength of the lattice boom 26 can be improved while suppressing an increase in weight.

In the case where the plate member (3, 4, 5, 7, or 8) is provided to the end surface of the reinforcing member 2, the stiffness of the reinforcing member 2 is improved by the plate member, and therefore the buckling strength of the pipe can be further improved.

In the case where the outer circumferential surface of the pipe and the reinforcing member 9 form a closed space in sectional view or in the case where a cylindrical reinforcing member is attached to the outer circumferential surface of the pipe, the stiffness of the reinforcing member can be further improved while suppressing an increase in weight. Accordingly, the buckling strength of the pipe can be further improved.

(Buckling Evaluation)

Figure 23:
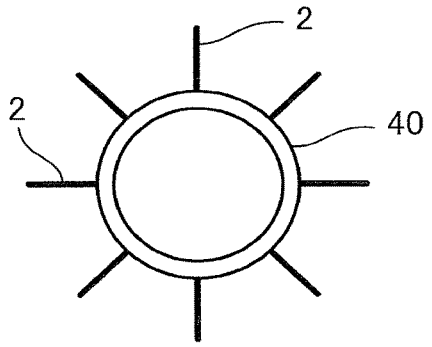
FIG. 23 is a sectional view of a pipe according to an embodiment of the present invention.

A buckling evaluation for a pipe 40 provided with the reinforcing member 2 was performed through an elasto-plastic analysis. The pipe 40 with a diameter of 200 mm, a plate thickness of 2 mm, and a length of 2000 mm was used. FIG. 23 is a sectional view of the pipe 40. The reinforcing member 2 with a height of 10 mm from the surface of the pipe 40 was used, and the analysis was performed under each of differing conditions of 1 mm and 5 mm in plate thickness. The analysis was performed under each of differing conditions of 500 mm, 760 mm, and 1000 mm in length of the reinforcing member 2 along the axial direction of the pipe 40. As shown in FIG. 23, eight reinforcing members 2 were arranged at equal intervals (45° intervals) in the circumferential direction of the outer circumferential surface of the pipe 40.

Figure 24:
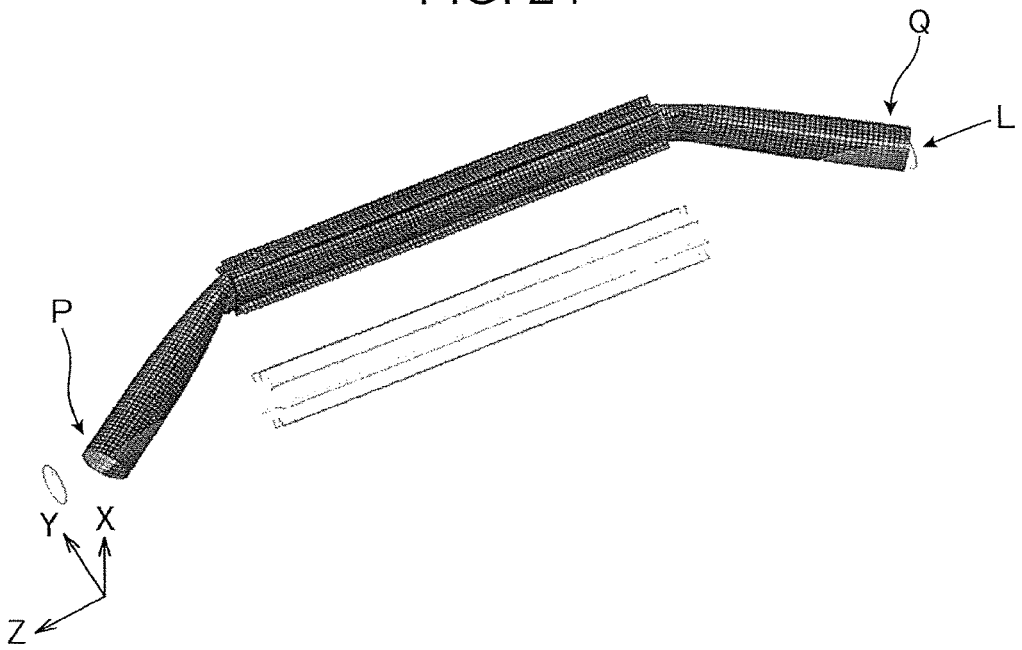
FIG. 24 is a view showing buckling of the pipe in FIG. 23.

FIG. 24 is a view showing buckling of the pipe 40 in FIG. 23. In FIG. 24, a forced displacement L is applied to the pipe 40 along the Z-axis direction that is the axial direction of the pipe 40. Herein, as analysis conditions, translations of a lower end P of the pipe 40 in the X-axis direction, Y-axis direction, and Z-axis direction were respectively restricted, and rotation of the lower end P of the pipe 40 about the Z-axis was restricted. Translations of an upper end Q of the pipe 40 in the X-axis direction and Y-axis direction were respectively restricted, and the forced displacement L of 60 mm was applied in the Z-axis direction.

Figure 25:
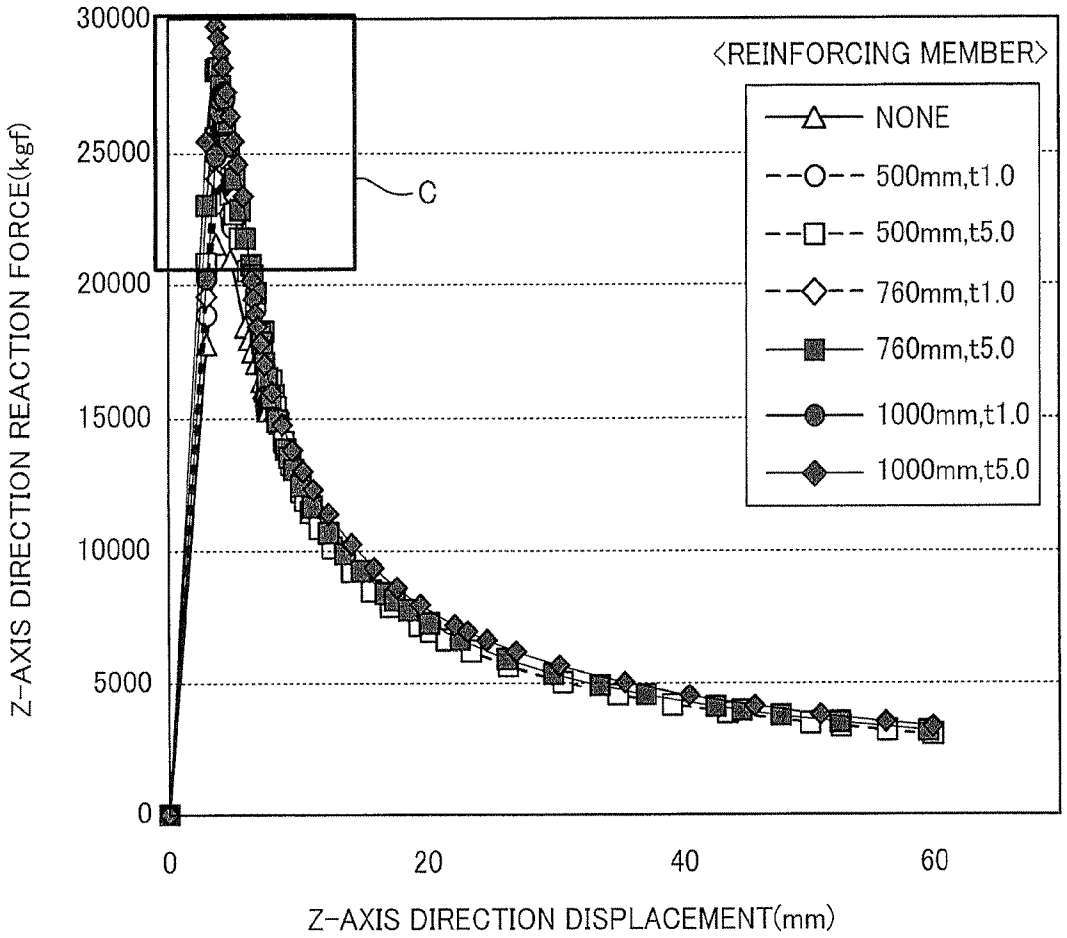
FIG. 25 is a graph showing the result of analysis of the relationship between the load applied on the pipe in FIG. 23 and the amount of displacement upon compression.
Figure 26:
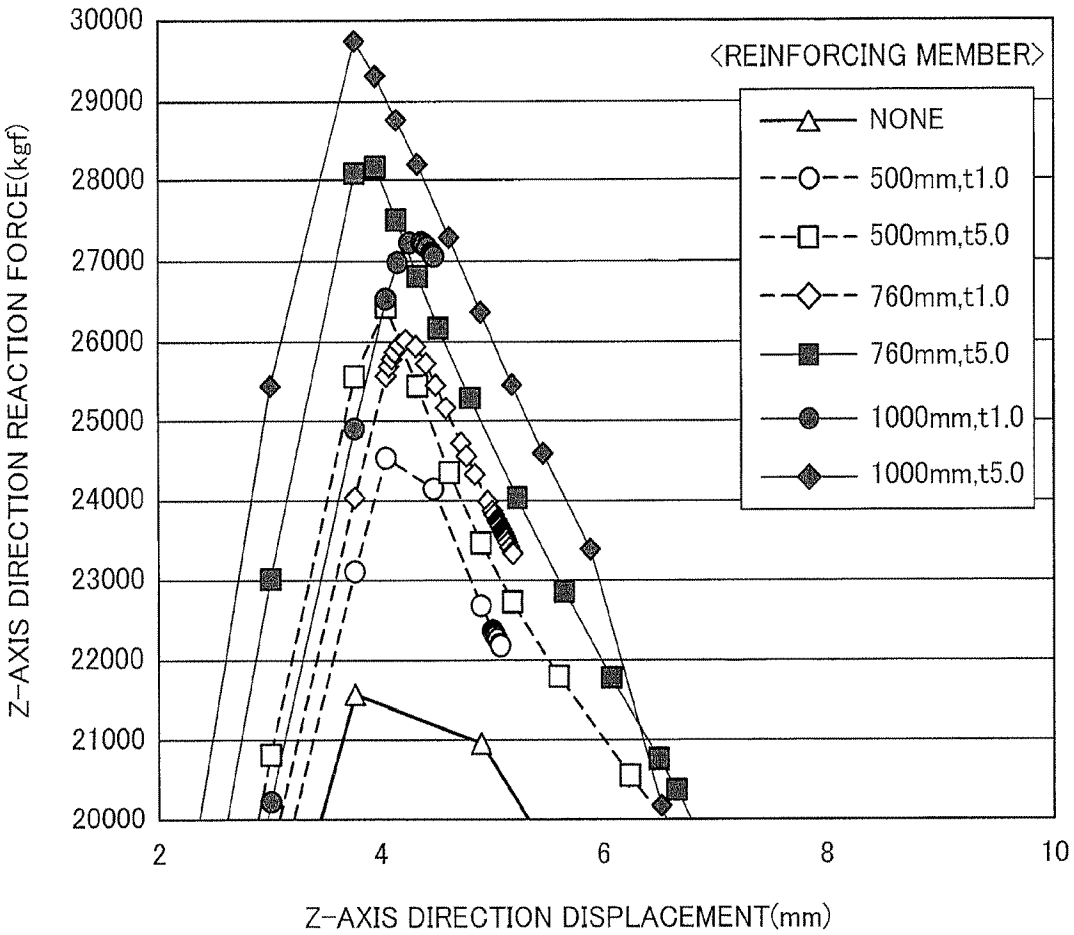
FIG. 26 is an enlarged view of a part denoted by C in the graph of FIG. 25.

FIG. 25 is a graph of the analysis result in the case where the forced displacement L is applied to the pipe 40 under the above conditions. FIG. 26 is an enlarged view of a part denoted by C in the graph of FIG. 25. The abscissa in FIGS. 25 and 26 is the forced displacement L (see FIG. 24) applied to the pipe 40, and the ordinate is the reaction force in the Z-axis direction that occurs from the pipe 40. When the forced displacement L applied to the pipe 40 is gradually increased from 0 in FIGS. 25 and 26, buckling of the pipe 40 occurs at a predetermined peak value. Under a "rib absent" condition (shown by a white triangle) in which the reinforcing member 2 is not provided to the pipe 40, the peak value (buckling load) was slightly lower than 22000 kgf, as shown in FIG. 26. In contrast, in the case (shown by a black circle in FIG. 26) where the reinforcing member 2 with a plate thickness of 1 mm and a length of 1000 mm is provided to the pipe 40, the peak value (buckling load) was slightly higher than 27000 kgf.

In the case where the reinforcing member 2 with a plate thickness of 1 mm and a length of 1000 mm is provided to the pipe 40, the buckling strength increased by 26%, while the weight of the pipe 40 increased by 6.5%. In contrast, in the case where the sectional area is increased by 6.5% over the entire length without changing the diameter of the pipe 40, i.e., in the case where the 6.5% increase in weight due to the reinforcing member 2 is used for thickening of the pipe 40, the buckling strength increases by 6.5%. Thus, it can be seen that reinforcement with the reinforcing member 2 is highly effective in terms of improvement in the buckling strength relative to a corresponding increase in weight.

Second Embodiment (Reinforcing Structure for Lattice Boom)

Figure 27:
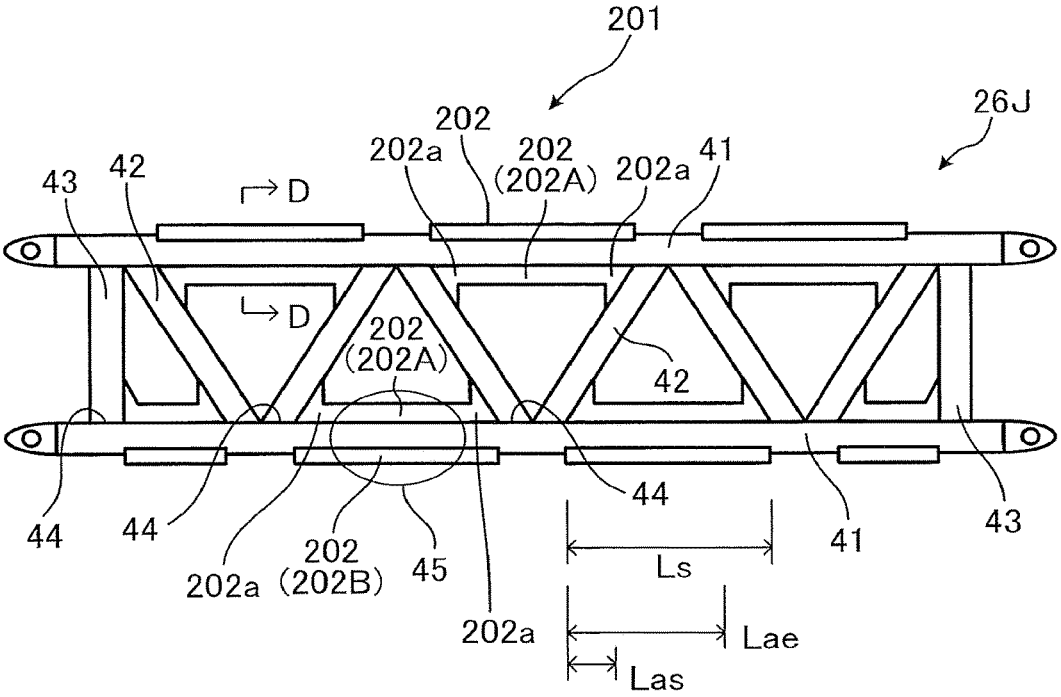
FIG. 27 is a side view of a lattice boom in a second embodiment of the present invention.

Next, a lattice boom 26J including a reinforcing structure 201 for a lattice boom according to a second embodiment of the present invention will be described. FIG. 27 is a side view of the lattice boom 26J. For the same component as the component described above, the same reference sign is assigned, and description will be omitted. The difference of the reinforcing structure 201 of the lattice boom 26J in this embodiment from the reinforcing structure 1 of the lattice boom 26 in the first embodiment is that, as shown in FIG. 27, one (202A) of three or more reinforcing members 202 arranged at the intermediate part 45 is arranged on a virtual plane (plane of the paper in FIG. 27) including the central axis of the main pipe 41 and the central axis of the lattice pipe 42 and that the reinforcing member 202A includes an extension 202*a* extending up to the connecting part 44. In other words, two ends of the reinforcing member 202A are respectively joined to the connecting parts 44.

Figure 28:
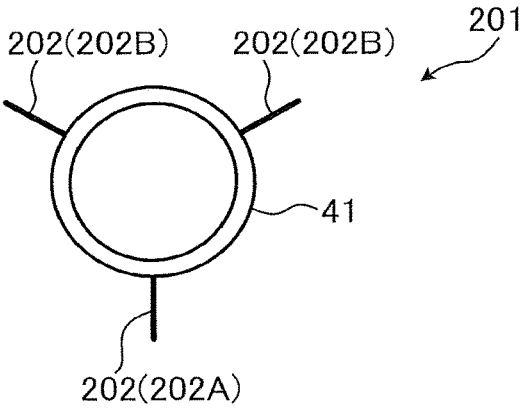
FIG. 28 is a sectional view on D-D in FIG. 27 in the second embodiment of the present invention.

In this embodiment, the reinforcing member 202 is provided to the outer circumferential surface of the main pipe 41. FIG. 28 is a sectional view on D-D in FIG. 27. As shown in FIG. 28, three reinforcing members 202 are provided at equal or approximately the same intervals in the circumferential direction of the outer circumferential surface of the main pipe 41. As shown in FIG. 28, one (202A) of the three reinforcing members 202 is arranged on a virtual plane (plane of the paper in FIG. 27) including the central axis of the main pipe 41 and the central axis of the lattice pipe 42, and the reinforcing member 202 includes the extension 202*a* extending up to the connecting part 44.

The other two reinforcing members 202 (202B) not including the extension 202*a* are arranged from the connecting part 44 up to the adjacent connecting part 44. That is, the length of the other two reinforcing members 202B is the length Ls of the interval between the adjacent connecting parts 44. The other two reinforcing members 202B may be arranged in a range where Las is greater than or equal to 5% of Ls and where Lae is less than or equal to 95% of Ls, in a similar manner to the first embodiment.

In this manner, the connecting part 44 is reinforced, by the extension 202*a* including the reinforcing member 202 (202A) arranged on the virtual plane including the central axis of the main pipe 41 and the central axis of the lattice pipe 42 being connected to the connecting part 44. Accordingly, the strength of the connecting part 44 can be improved. The arrangement of the reinforcing member 202A including the extension 202*a* between the connecting parts 44 allows for reinforcement of a part that has become desirable after the lattice boom 26 has been assembled. Further, a worker does not need to perform reinforcement work of arranging the reinforcing member 202 such that the reinforcing member 202 spans across the connecting part 44. Therefore, workability of the reinforcement can be improved.

While in this embodiment the reinforcing member 202 is provided to each of the respective intermediate parts 45 of the main pipes 41, the reinforcing member 202 may be provided to only a certain intermediate part 45 of the main pipes 41.

Modified Example

Figure 29:
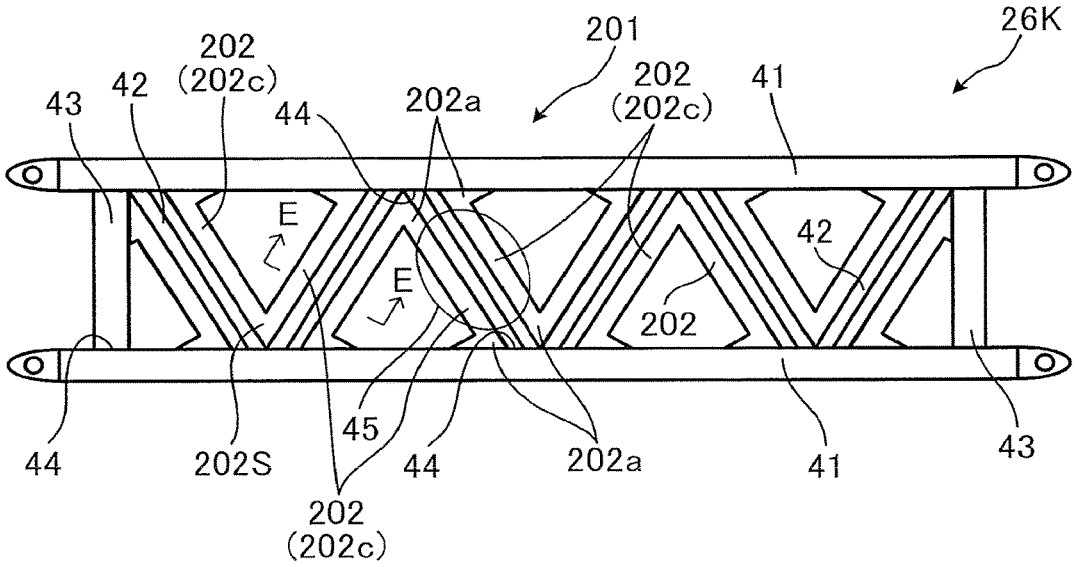
FIG. 29 is a side view of a lattice boom in a nineteenth modified example of the present invention.
Figure 30:
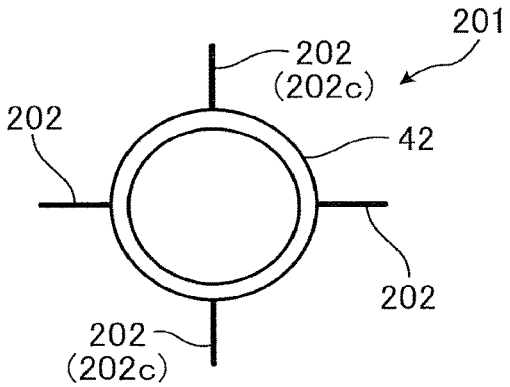
FIG. 30 is a sectional view on E-E in FIG. 29 in the nineteenth modified example of the present invention.

Next, modified examples will be described. FIG. 29 is a side view of a lattice boom 26K according to a nineteenth modified example. As shown in FIG. 29, the reinforcing member 202 is provided to each of the respective intermediate parts 45 of the lattice pipes 42. FIG. 30 is a sectional view on E-E in FIG. 29. As shown in FIG. 30, four reinforcing members 202 are provided at equal or approximately the same intervals in the circumferential direction of the outer circumferential surface of the lattice pipe 42. Of the four reinforcing members 202, as shown in FIG. 29, two reinforcing members 202 (202C) that differ in circumferential position by 180° or approximately 180° are arranged on a virtual plane (plane of the paper in FIG. 29) including the central axis of the main pipe 41 and the central axis of the lattice pipe 42 and each include the extension 202*a* extending up to the connecting part 44.

In the adjacent lattice pipes 42, the extension 202*a* of the reinforcing member 202C provided to one and the extension 202*a* of the reinforcing member 202C provided to the other are integrated to form an integrated part 202S. By the extensions 202*a* being integrated in this manner, the stiffness of the reinforcing member 202 (202C) including the extension 202*a* is improved, and therefore the buckling strength of the lattice pipe 42 can be further improved.

While in this modified example the reinforcing member 202 is provided to each of the respective intermediate parts 45 of the lattice pipe 42, the reinforcing member 202 may be provided to only a certain intermediate part 45 of the lattice pipes 42.

Figure 31:
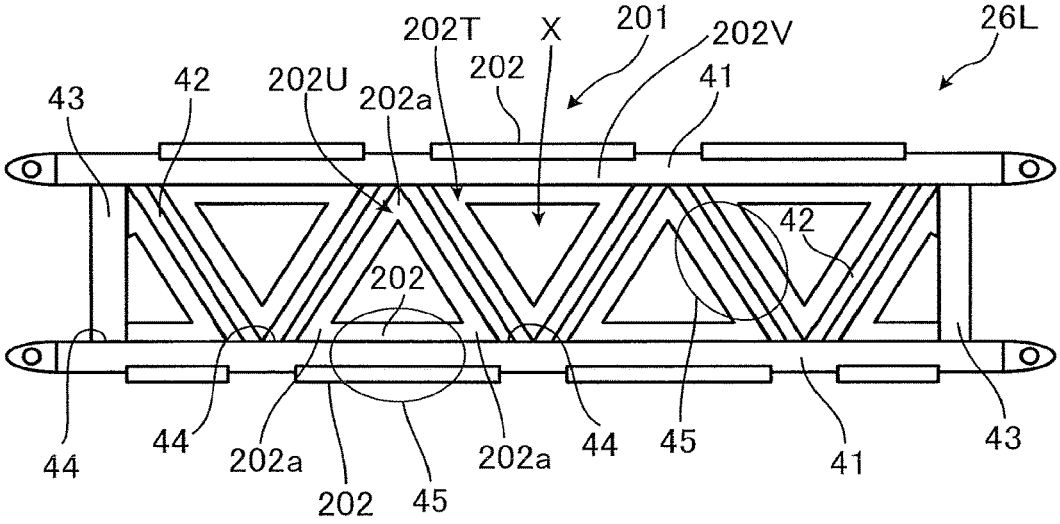
FIG. 31 is a side view of a lattice boom in a twentieth modified example of the present invention.

FIG. 31 is a side view of a lattice boom 26L according to a twentieth modified example. As shown in FIG. 31, the reinforcing member 202 is provided to each of the respective intermediate parts 45 of the main pipes 41 and the respective intermediate parts 45 of the lattice pipes 42. Three reinforcing members 202 provided to the main pipe 41 are provided at equal or approximately the same intervals in the circumferential direction of the outer circumferential surface of the main pipe 41. One of the three reinforcing members 202 is arranged on a virtual plane (plane of the paper in FIG. 31) including the central axis of the main pipe 41 and the central axis of the lattice pipe 42 and includes the extension 202*a* extending up to the connecting part 44.

Four reinforcing members 202 provided to the lattice pipe 42 are provided at equal or approximately the same intervals in the circumferential direction of the outer circumferential surface of the lattice pipe 42. Of the four reinforcing members 202, two reinforcing members 202 that differ in circumferential position by 180° or approximately 180° are arranged on the virtual plane (plane of the paper in FIG. 31) including the central axis of the main pipe 41 and the central axis of the lattice pipe 42 and each include the extension 202*a* extending up to the connecting part 44.

The extension 202*a* of the reinforcing member 202 provided to the main pipe 41 and the extension 202*a* of the reinforcing member 202 provided to the lattice pipe 42 are integrated to form an integrated part 202T. Further, in the adjacent lattice pipes 42, the extension 202*a* of the reinforcing member 202 provided to one and the extension 202*a* of the reinforcing member 202 provided to the other are integrated to form an integrated part 202U. As a result, in the lattice boom 26L in FIG. 31, a part of the reinforcing members 202 of the reinforcing structure 201 in a plurality of parts can be fixed collectively, by fitting and connecting a triangular reinforcing member 202V in a space X between one main pipe 41 and the two adjacent lattice pipes 42. By the extensions 202*a* being integrated in this manner, the stiffness of the reinforcing member 202 including the extension 202*a* is improved, and therefore the buckling strength of the pipe can be further improved.

While in this modified example the reinforcing member 202 is provided to each of the respective intermediate parts 45 of the main pipes 41 and the respective intermediate parts 45 of the lattice pipes 42, the reinforcing member 202 may be provided to only a certain intermediate part 45 of the main pipes 41 and a certain intermediate part 45 of the lattice pipes 42.

In the second embodiment and the nineteenth and twentieth modified examples described above as well, the tenth to eighteenth modified examples (see FIGS. 14 to 22) may be applied. The reinforcing members 202 may be provided on the side on which load is applied, instead of being provided at equal or approximately the same intervals.

Advantageous Effect

With the reinforcing structure 201 for a lattice boom according to this embodiment, as described above, the connecting part 44 is reinforced, by the extension 202*a* including the reinforcing member 202 arranged on the virtual plane including the central axis of the main pipe 41 and the central axis of the lattice pipe 42 being connected to the connecting part 44. Accordingly, the strength of the connecting part 44 can be improved. The arrangement of the reinforcing member 202 including the extension 202*a* between the connecting parts 44 allows for reinforcement of a part that has become desirable after the lattice boom 26 has been assembled. Further, a worker does not need to perform reinforcement work of arranging the reinforcing member 202 such that the reinforcing member 202 spans across the connecting part 44, and therefore workability of the reinforcement can be improved.

The embodiments of the present invention described above merely illustrate specific examples and do not particularly limit the present invention. The specific configuration or the like can be appropriately changed in design. The workings and advantageous effects described in the embodiments of the invention are merely presented as the most preferable workings and advantageous effects resulting from the present invention. The workings and advantageous effects of the present invention are not limited to those described in the embodiments of the present invention.

This application is based on Japanese Patent application No. 2015-170991 filed in Japan Patent Office on Aug. 31, 2015, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A lattice boom comprising:

a plurality of main pipes extending in a longitudinal direction of the lattice boom;

a plurality of lattice pipes extending in a connecting direction that intersects with the longitudinal direction and each including two ends respectively connected to a pair of adjacent main pipes, among the plurality of main pipes, to connect the pair of main pipes; and a reinforcing part provided on at least one of an outer circumferential surface of a main pipe among the plurality of main pipes and an outer circumferential surface of a lattice pipe among the plurality of lattice pipes, the pair of adjacent main pipes being connected to each other at a plurality of connecting parts by the plurality of lattice pipes, wherein the reinforcing part is provided to at least one of a first area between first specific connecting parts, out of the plurality of connecting parts, adjacent to each other at a predetermined interval along the longitudinal direction on the outer circumferential surface of the main pipe and the lattice pipe, and a second area between second specific connecting parts, out of the plurality of connecting parts, on two end sides of the lattice pipe, the reinforcing part includes a plurality of reinforcing members that extend along an axial direction of a specific pipe, which is at least one of the main pipe and the lattice pipe, the specific pipe including the reinforcing part, and the plurality of reinforcing members being arranged at intervals on the outer circumferential surface of the specific pipe along a circumferential direction of the specific pipe, a length of a reinforcing member among the plurality of reinforcing members in the axial direction is set to a value less than an interval between the first specific connection parts adjacent to each other in the axial direction or an interval between the second specific connecting parts adjacent to each other in the axial direction, and the reinforcing member has opposite ends in the axial direction, the opposite ends being spaced from the first specific connecting parts or the second specific connecting parts on the specific pipe.

2. The lattice boom according to claim 1, wherein the plurality of reinforcing members are three or more reinforcing members provided in the circumferential direction of the outer circumferential surface.

3. The lattice boom according to claim 1, wherein the plurality of reinforcing members are arranged at equal or approximately equal intervals in the circumferential direction of the outer circumferential surface.

4. The lattice boom according to claim 1, wherein at least one of the plurality of reinforcing members is arranged on a virtual plane including a central axis of the main pipe and a central axis of the lattice pipe, and an end, in the axial direction, of the reinforcing member arranged on the virtual plane is joined to the connecting part connecting the main pipe and the lattice pipe.

5. The lattice boom according to claim 1, wherein the plurality of reinforcing members are provided to only the outer circumferential surface of the main pipe.

6. The lattice boom according to claim 1, wherein the plurality of reinforcing members are provided to only the outer circumferential surface of the lattice pipe.

7. The lattice boom according to claim 1, wherein the plurality of reinforcing members each include a first member extending outward from the outer circumferential surface of the pipe, and a second member connected to a tip end of the first member orthogonally to the first member.

8. The lattice boom according to claim 1, wherein, on a sectional plane orthogonal to the axial direction of the pipe which includes the reinforcing part, the outer circumferential surface of the pipe and the reinforcing member form a closed space.

9. The lattice boom according to claim 1, wherein the reinforcing members are cylindrical.

10. The lattice boom according to claim 1, wherein the reinforcing member is attached to the main pipe or the lattice pipe after the main pipe and the lattice pipe are connected to each other.

11. The lattice boom according to claim 1, wherein when a length between two connecting parts, out of the first or second specific connecting parts, adjacent to each other at the predetermined interval is defined as Ls, a length from one of the two connecting parts as a starting point to one end of the reinforcing member that is closer to the starting point is defined as Las, and a length from the starting point to the other end of the reinforcing member that is opposite to the one end is defined as Lae, each of the plurality of reinforcing members included in the reinforcing part is arranged such that Las is greater than or equal to 5% of Ls and Lae is less than or equal to 95% of Ls.

* * * * *